US009604371B2

(12) United States Patent
Matthews et al.

(10) Patent No.: US 9,604,371 B2
(45) Date of Patent: Mar. 28, 2017

(54) INTERLOCKING KNIVES

(71) Applicants: Michael Matthews, St. Augustine, FL (US); Brian Arsenault, St. Augustine, FL (US)

(72) Inventors: Michael Matthews, St. Augustine, FL (US); Brian Arsenault, St. Augustine, FL (US)

( * ) Notice: Subject to any disclaimer, the term of this patent is extended or adjusted under 35 U.S.C. 154(b) by 34 days.

(21) Appl. No.: 14/729,478

(22) Filed: Jun. 3, 2015

(65) Prior Publication Data

US 2016/0354937 A1 Dec. 8, 2016

(51) Int. Cl.
*B26B 11/00* (2006.01)
*B26B 5/00* (2006.01)

(52) U.S. Cl.
CPC ..... *B26B 11/006* (2013.01); *B26B 5/00* (2013.01)

(58) Field of Classification Search
CPC ..... B26B 11/006; B26B 5/00
USPC ..... 30/122, 299
See application file for complete search history.

(56) References Cited

U.S. PATENT DOCUMENTS 279,643 A * 6/1883 Gilberts ..... B26D 3/185 30/303
293,542 A * 2/1884 Victor ..... B26D 3/185 30/303
452,789 A * 5/1891 Hutchinson ..... B26D 3/185 172/378
4,312,129 A * 1/1982 Fergusson ..... A63H 27/08 244/155 R
4,349,202 A * 9/1982 Scott ..... F42B 6/08 30/303
4,928,969 A * 5/1990 Nagatori ..... F42B 6/08 473/584
5,389,033 A * 2/1995 Rauch ..... A63H 33/009 446/473
6,258,000 B1 * 7/2001 Liechty, II ..... F42B 6/08 473/583
6,976,311 B2 12/2005 Lee
7,266,894 B1 * 9/2007 Hinckley ..... B26D 1/0006 30/302
8,100,788 B2 * 1/2012 Sanford ..... F42B 6/08 473/582
RE44,144 E * 4/2013 Barrie ..... 473/583
8,555,514 B2 10/2013 Jensen
2012/0023753 A1 2/2012 Wen
2016/0354937 A1 * 12/2016 Matthews ..... B26B 5/00

* cited by examiner

*Primary Examiner* — Hwei C Payer
(74) *Attorney, Agent, or Firm* — Dunlap Bennett & Ludwig PLLC

(57) ABSTRACT

Interlocking knives are provided. The interlocking knives include at least a first knife and a second knife. The first knife includes a blade and a handle. At least one slot may be formed through the blade of the first knife. The second knife also includes a blade and a handle. The second knife includes at least one slot. The at least one slot of the second knife interlocks with the at least one slot on the first knife. A swivel plate may be pivotally connected to the first knife. The swivel plate is operable to pivot towards the second knife into a locked position, securing the second knife to the first knife.

10 Claims, 5 Drawing Sheets

INTERLOCKING KNIVES

BACKGROUND OF THE INVENTION

The present invention relates to knives and, more particularly, to interchangeable and connectable knives.

A knife (plural knives) is a cutting tool with a cutting edge handle, hand-held or otherwise, with a handle. Currently, knives are separate from one another and lack interchangeability.

As can be seen, there is a need for interchangeable knives that may be connected together as one knife.

SUMMARY OF THE INVENTION

In one aspect of the present invention, an attachable knife system comprises: a first knife comprising a blade and a handle, wherein the first knife comprises at least one slot formed through the blade; a second knife comprising a blade and a handle, wherein the second knife comprises at least one slot; and a swivel plate pivotally connected to the first knife, wherein the at least one slot of the second knife interlocks with the at least one slot on the first knife, wherein the swivel plate is operable to pivot towards the second knife into a locked position, securing the second knife to the first knife.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
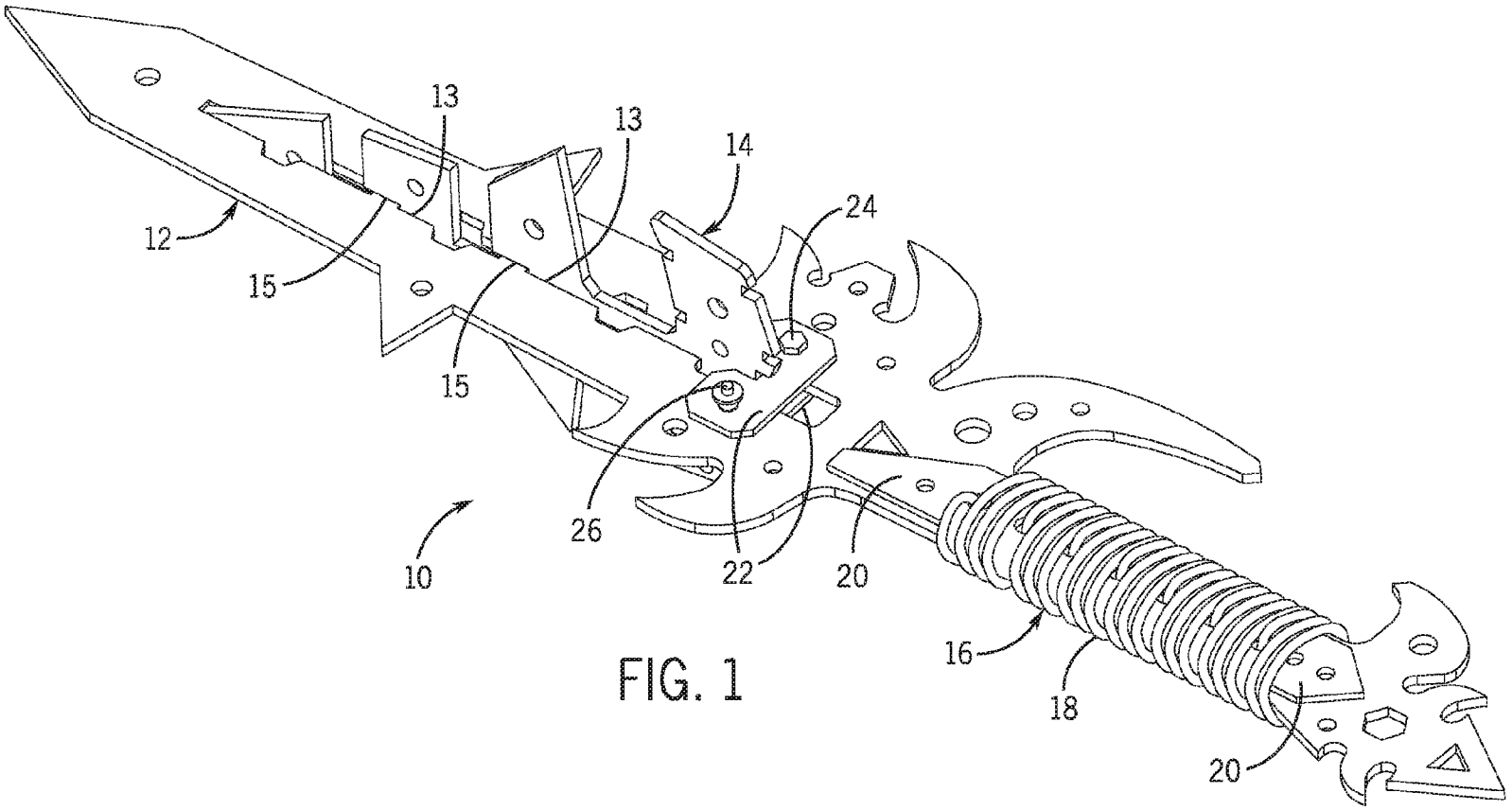
FIG. 1 is a perspective view of an embodiment of the present invention.
Figure 2:
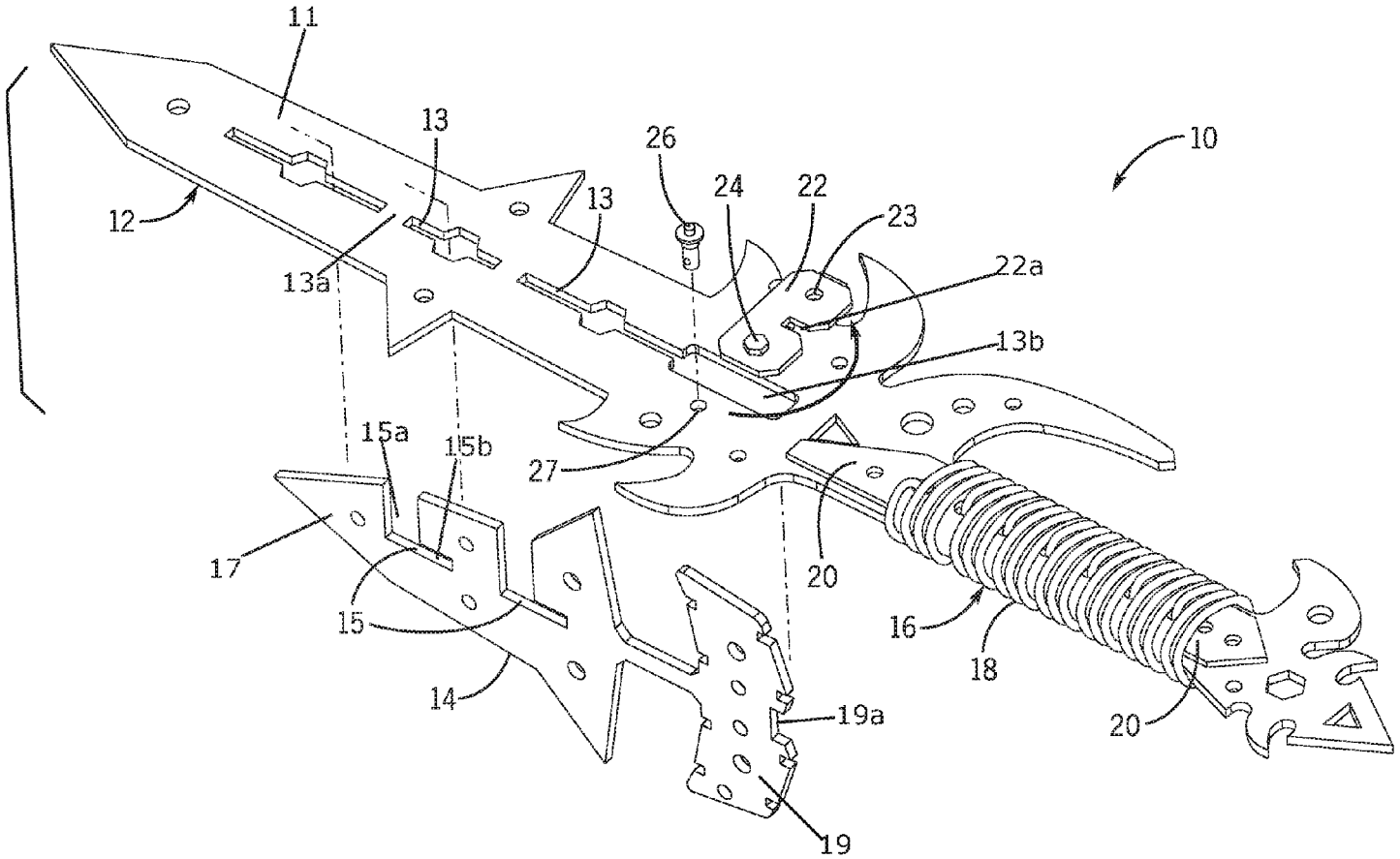
FIG. 2 is an exploded perspective view of an embodiment of the present invention.
Figure 3:
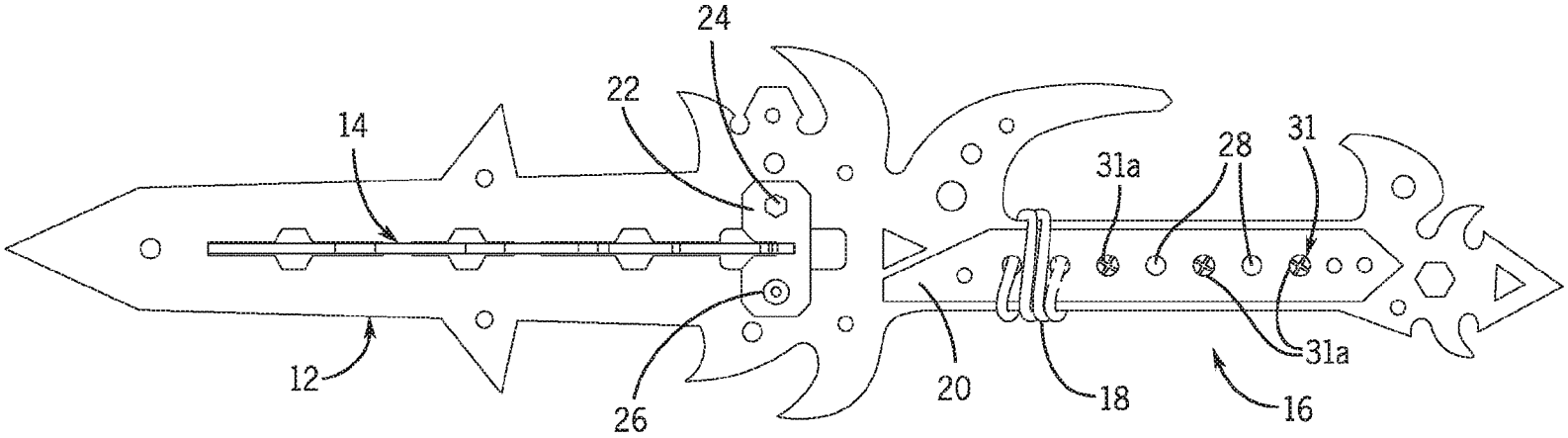
FIG. 3 is a top plan view of an embodiment of the present invention.
Figure 4:
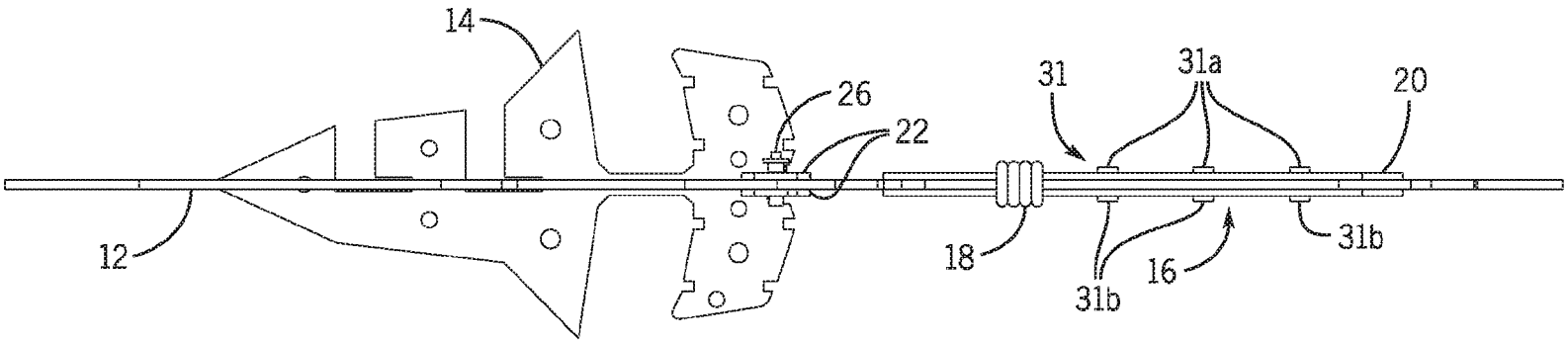
FIG. 4 is a side elevation view of an embodiment of the present invention.
Figure 5:
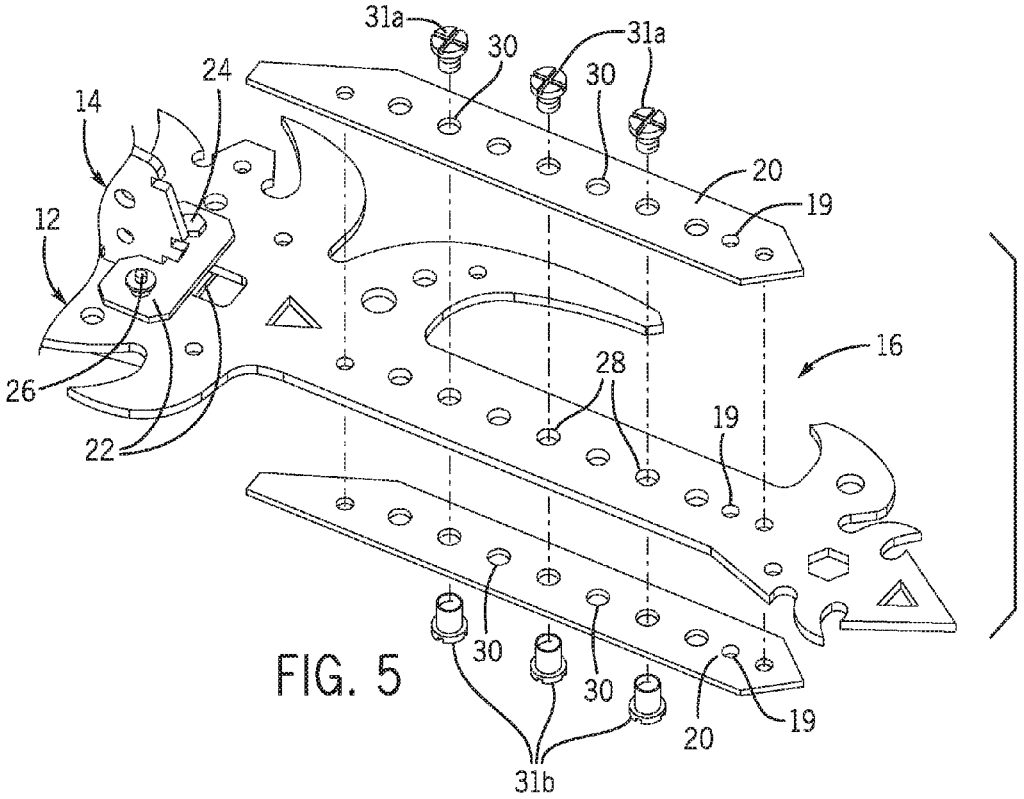
FIG. 5 is an exploded detail perspective view.
Figure 6:
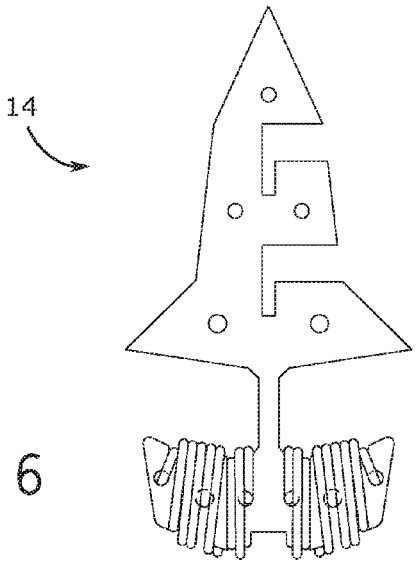
FIG. 6 is a perspective view of a second knife of the present invention.
Figure 7:
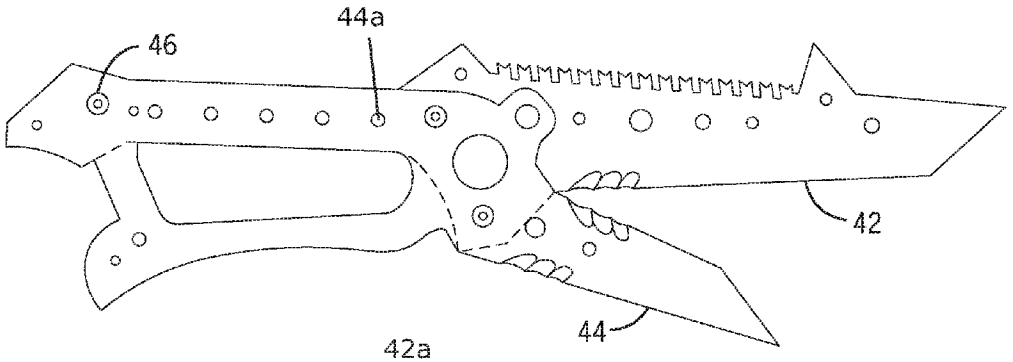
FIG. 7 is a side elevation view of an alternate embodiment of the present invention.
Figure 8:
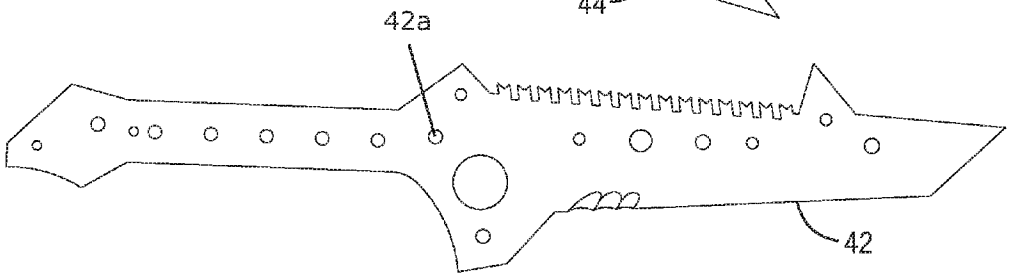
FIG. 8 is a side elevation view of the base component of the alternate embodiment.
Figure 9:
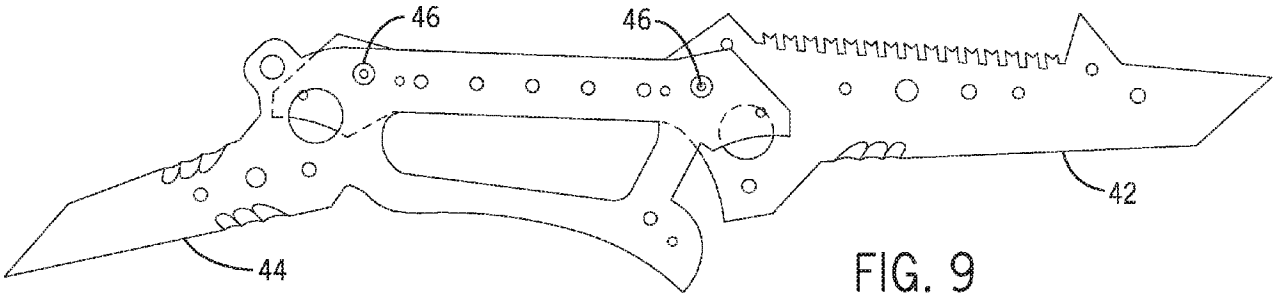
FIG. 9 is a side elevation view showing the second component rotated to an alternate position.

Referring to FIGS. 1 through 9, the present invention includes interlocking knives 10. The interlocking knives 10 include at least a first knife 12 and a second knife 14. The first knife 12 may be larger than the second knife 14, and may be considered a sword. The first knife 12 includes a blade 11 and a handle 16. At least one slot 13 may be formed through the blade of the first knife 12. The second knife 14 also includes a blade 17 and a handle 19. The second knife 14 includes at least one slot 15. The at least one slot 15 of the second knife 14 interlocks with the at least one slot 13 on the first knife 12. A swivel plate 22 may be pivotally connected to the first knife 12. The swivel plate 22 is operable to pivot towards the second knife 14 into a locked position, securing the second knife 14 to the first knife 12. The first knife 12 and the second knife 14 may be substantially perpendicular relative to one another when secured together.

In certain embodiments, the first knife 12 may include a first and second slot 13 and the second knife 14 may include a first and second slot 15. The first knife 12 may further include a handle slot 13*b* to receive and secure the handle 19 of the second knife 14 within. In certain embodiments, each slot 15 of the second knife 14 may include an entry portion 15*a* and a locking portion 15*b*. The entry portion 15*a* may be formed at an edge of the second knife 14 and may lead towards a center of the knife 14 where the entry portion 15*a* intersects with the narrow locking portion 15*b*. The locking portion 15*b* may run perpendicular to the entry portion 15*a*. To attach the second knife 14 to the first knife 12, a locking section 13*a* in between the slots 13 of the first knife 12 enters into the entry portion 15*a* of the slot 15. Once the locking section 13*a* meets the locking portion 15*b*, the locking section 13*a* is slid into the locking portion 15*b*, thereby interlocking the first knife 12 and the second knife 14.

The swivel plate 22 of the present invention is pivotally attached to the first knife 12 at a pivot point 24. The pivot point 24 may be adjacent to the handle slot 13*b* so that the swivel plate 22 may pivot over the handle slot 13*b*, abutting the handle 19 of the second knife 14 in the locked position. The swivel plate 22 may include a slot 22*a* that is interlockable with a slot 19*a* of the second knife 14. In certain embodiments, the first knife 12 includes a receiving hole 27 on an opposite side of the handle slot 13*b* as the pivot point 24. The swivel plate 22 includes a receiving hole 23. The swivel plate 22 may pivot over the handle slot 13*b* so that the receiving holes 23, 27 may align. A locking pin 26 fits through the aligned receiving holes 23, 27, and thereby locks the swivel plate 22 in the locked position.

In certain embodiments, the handle 16 of the first knife 12 is an interchangeable handle 16. The handle 16 of the first knife 12 may include a plurality of receiving holes 28. A first and second handle inlay 20 may each include a plurality of receiving holes 30 that align with the receiving holes 28 of the handle. The receiving holes 28, 30 may align with one another and binding posts 31*a*, 31*b*, may run through the aligned receiving holes 28, 30, thereby binding the handle inlays 20 to the handle 16 of the first knife 12. The binding posts 31*a*, 31*b*, may include male components 31*a* and female components 31*b* that easily snap together. To add additional decoration and utility, paracords 18 may be wrapped around the attached handle and handle inlays 20, running through paracord tie holes 19.

The knives 12, 14, 42, 44 may interlock by other means. For example, a third knife 42 may include a plurality of receiving holes 42*a* and a fourth knife 44 may include a plurality of receiving holes 44*a*. The receiving holes 42*a*, 44*a* of the third and fourth knives 42, 44 may align with one another. Quick release pins 46 may run through the aligning receiving holes 42*a*, 44*a*, thereby attaching the third and fourth knives 42, 44 together. Further, the third and fourth knives 42, 44 may be attachable to the first knife 12. For example, the third and fourth knives 42, 44 may include receiving holes 42*a*, 44*a* that align with receiving holes of the first knife 12. Quick release pins 46 may run through the aligning receiving holes 42*a*, 44*a*, thereby attaching the third and fourth knives 42, 44 to the first knife 12.

It should be understood, of course, that the foregoing relates to exemplary embodiments of the invention and that modifications may be made without departing from the spirit and scope of the invention as set forth in the following claims.

What is claimed is:

1. An interlocking knife system comprising:

a first knife comprising a blade and a handle, wherein the first knife comprises at least one slot and a handle slot formed through the blade;

a second knife comprising a blade and a handle, wherein the second knife comprises at least one slot; and a swivel plate pivotally connected to the first knife, wherein the at least one slot of the second knife interlocks with the at least one slot on the first knife and the handle of the second knife is disposed within the handle slot of the first knife, wherein the swivel plate is operable to pivot towards the second knife into a locked position, securing the second knife to the first knife.

2. An interlocking knife system comprising:

a first knife comprising a blade and a handle, wherein the first knife comprises at least one slot formed through the blade;

a second knife comprising a blade and a handle, wherein the second knife comprises at least one slot comprising an entry portion leading to a locking portion, wherein the locking portion is perpendicular to the entry portion; and a swivel plate pivotally connected to the first knife, wherein the at least one slot of the second knife interlocks with the at least one slot on the first knife, wherein the swivel plate is operable to pivot towards the second knife into a locked position, securing the second knife to the first knife.

3. An interlocking knife system comprising:

a first knife comprising a blade and a handle, wherein the first knife comprises a first slot and a second slot formed through the blade;

a second knife comprising a blade and a handle, wherein the second knife comprises a first slot and a second slot; and a swivel plate pivotally connected to the first knife, wherein the first slot and the second slot of the second knife interlocks with the first slot and the second slot of the first knife, wherein the swivel plate is operable to pivot towards the second knife into a locked position, securing the second knife to the first knife.

4. The interlocking knife system of claim 3, wherein the first knife comprises a handle slot formed through the blade of the first knife, and sized to receive the handle of the second knife within.

5. The interlocking knife system of claim 4, wherein the swivel plate is pivotally attached to the blade of the first knife by a pivot point adjacent to the handle slot so that the swivel plate pivots over the handle slot and abuts the handle of the second knife in the locked position.

6. The interlocking knife system of claim 5, wherein the first knife comprises a receiving hole on an opposite side of the handle slot as the pivot point, wherein the swivel plate comprises a receiving hole, wherein in the locked position the swivel plate is pivoted over the handle slot so that the receiving hole of the swivel plate aligns with the receiving hole of the first knife, wherein a locking pin fits through the aligned receiving holes, thereby locking the swivel plate in the locked position.

7. The interlocking knife system of claim 5, wherein the swivel plate comprises a slot interlockable with the handle of the second knife.

8. The interlocking knife system of claim 3, wherein the first slot and the second slot of the second knife each comprises an entry portion leading to a locking portion, wherein the locking portion is perpendicular to the entry portion.

9. The interlocking knife system of claim 3, wherein when the first knife and the second knife are secured together, the first knife is substantially perpendicular to the second knife.

10. The interlocking knife system of claim 3, further comprising at least one handle inlay comprising a plurality of receiving holes, wherein the handle of the first knife comprises a plurality of receiving holes that align with the plurality receiving holes of the handle inlay, wherein each of the aligned receiving holes are sized to receive a locking pin within, thereby locking the handle inlay to the handle of the first knife.

* * * * *